US008215628B2

(12) United States Patent
Taguchi

(10) Patent No.: US 8,215,628 B2
(45) Date of Patent: Jul. 10, 2012

(54) FOLDING ROLLER CONTROL FOR SHEET PROCESSING APPARATUS/METHOD

(75) Inventor: Hiroyuki Taguchi, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 248 days.

(21) Appl. No.: 12/695,931

(22) Filed: Jan. 28, 2010

(65) Prior Publication Data

US 2010/0194018 A1 Aug. 5, 2010

Related U.S. Application Data

(60) Provisional application No. 61/150,281, filed on Feb. 5, 2009.

(51) Int. Cl.
*B65H 37/04* (2006.01)

(52) U.S. Cl. ..... 270/45; 270/32; 270/37; 270/58.09; 493/444; 493/445

(58) Field of Classification Search ..... 270/37, 270/45, 32, 58.08, 58.09; 493/444, 445
See application file for complete search history.

(56) References Cited

U.S. PATENT DOCUMENTS

| | | | | |
|---|---|---|---|---|
| 6,003,853 | A * | 12/1999 | Nakazawa et al. | 270/58.11 |
| 6,746,390 | B2 * | 6/2004 | Tamura et al. | 493/445 |
| 2008/0150211 | A1 * | 6/2008 | Iguchi | 270/37 |
| 2008/0185763 | A1 * | 8/2008 | Iguchi | 270/37 |
| 2008/0185764 | A1 * | 8/2008 | Dobashi | 270/37 |
| 2008/0217834 | A1 * | 9/2008 | Sasahara | 270/37 |

FOREIGN PATENT DOCUMENTS

JP 2003-2532 A 1/2003

* cited by examiner

*Primary Examiner* — Patrick Mackey
(74) *Attorney, Agent, or Firm* — Patterson & Sheridan, LLP

(57) ABSTRACT

A sheet processing apparatus includes: a sheet processing apparatus control unit; a folding motor, a rotating direction of which is controlled by the sheet processing apparatus control unit; a low-speed gear train configured to be driven when the folding motor normally rotates; a high-speed gear train configured to be driven when the folding motor reversely rotates; and a saddle-folding driving roller configured to be driven by a gear train selected from the low-speed gear train and the high-speed gear train. When the number of recording media to be saddle-stapled or saddle-folded exceeds predetermined numbers respectively set for the saddle stapling and the saddle folding, the sheet processing apparatus control unit drives the saddle-folding driving roller at low speed. When the number of recording media to be saddle-stapled or saddle-folded does not exceed the predetermined numbers, the sheet processing apparatus control unit drives the saddle-folding driving roller at high speed.

17 Claims, 6 Drawing Sheets

FOLDING ROLLER CONTROL FOR SHEET PROCESSING APPARATUS/METHOD

CROSS-REFERENCE TO RELATED APPLICATIONS

This application is based upon and claims the benefit of priority from the prior U.S. Patent Application No. 61/150,281, filed on 5 Feb. 2009, the entire contents of which are incorporated herein by reference.

TECHNICAL FIELD

The present invention relates to a sheet processing apparatus set in an image forming apparatus such as a copying machine, and, more particularly to a sheet processing apparatus with processing efficiency of saddle folding improved and a saddle folding speed control method for the sheet processing apparatus.

BACKGROUND

A sheet processing apparatus receives recording media having images formed thereon discharged from an image forming apparatus and executes post-processing such as stapling, punching, or saddle folding. In particular, concerning the saddle folding, a reduction in time for the processing is demanded.

For example, JP-A-2003-2532 discloses a technique for executing saddle folding at low speed, i.e., high torque until saddle-folded recording media are conveyed by a predetermined distance from a nipping position of a pair of saddle folding rollers that saddle-fold the recording media and thereafter discharging the recording media at high speed.

However, when a large number of recording media are saddle-folded, it is necessary to saddle-fold the recording media at high torque. On the other hand, when a small number of recording media are saddle-folded, it is unnecessary to saddle-fold the recording media at high torque. With the technique explained above, since recording media are saddle-folded at low speed irrespectively of the number of recording media to be saddle-folded, a reduction in processing time for saddle folding is insufficient.

SUMMARY

It is an object of the present invention to provide a sheet processing apparatus and a saddle folding speed control method for the sheet processing apparatus that can reduce time required for saddle folding.

In an aspect of the present invention, a sheet processing apparatus includes:

a conveying mechanism configured to receive recording media having images formed thereon from an image forming apparatus and convey the recording media;

a longitudinal alignment device configured to temporarily stack the conveyed recording media and align the recording media in a longitudinal direction;

a moving device configured to move the aligned recording media to a saddle folding position;

a saddle folding blade configured to push in the recording media moved to the saddle folding position;

a saddle-folding driving roller and a saddle-folding driven roller as a pair of rollers configured to hold the pushed-in recording media in a nip section and perform saddle folding; and a control unit configured to drive the saddle-folding driving roller at low speed when the number of recording media to be saddle-folded exceeds a predetermined number and drive the saddle-folding driving roller at high speed when the number of recording media to be saddle-folded does not exceed the predetermined number.

DETAILED DESCRIPTION

Throughout this description, the embodiments and examples shown should be considered as exemplars, rather than limitations on the apparatus and methods of the present invention.

A sheet processing apparatus according to an embodiment of the present invention is explained in detail below with reference to the accompanying drawings.

Figure 1:
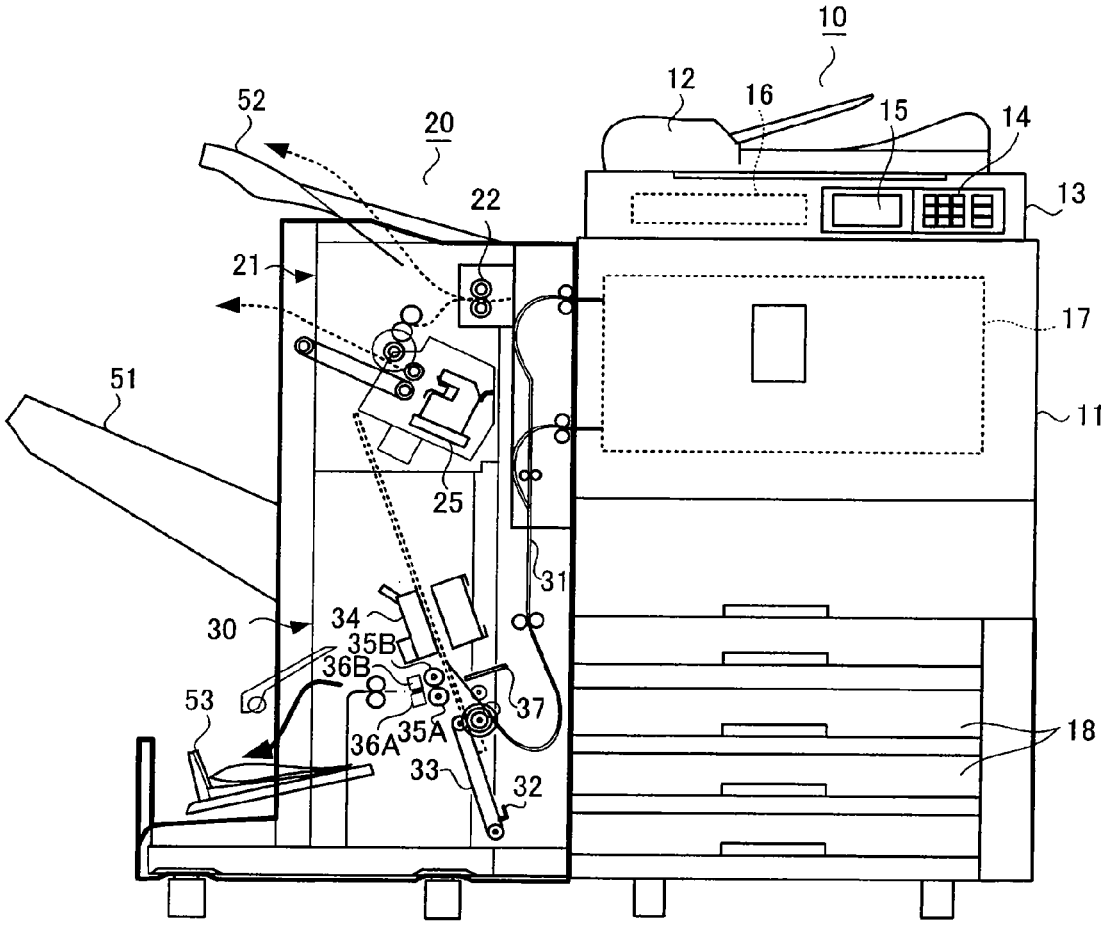
FIG. 1 is a side sectional view of a sheet processing apparatus.

FIG. 1 is a side sectional view of a sheet processing apparatus 20 according to this embodiment. As shown in FIG. 1, the sheet processing apparatus 20 is set adjacent to an image forming apparatus 10 such as a copying machine, a MFP (Multifunction Peripheral), or a printer.

The image forming apparatus 10 includes an automatic document feeding device 12 configured to feed original documents one by one, a scan unit 16 configured to read the document, and sheet cassettes 18 configured to store recording media. The image forming apparatus 10 further includes a main body unit 11 having housed therein an image forming unit 17 configured to form images on the recording media conveyed one by one from the sheet cassettes 18 and a control unit 13 including a control panel 15 and operation buttons 14. The image forming apparatus 10 passes the recording media having the images formed thereon to the sheet processing apparatus 20.

The sheet processing apparatus 20 includes a stapling mechanism 21 configured to perform stapling and a saddle folding unit 30 configured to perform saddle folding.

The stapling mechanism 21 includes a stapler 25 configured to staple recording media conveyed by conveying rollers 22.

When neither the stapling nor the saddle folding is performed, the recording media are discharged to a paper discharge tray 52 in an upper stage. The stapled recording media are discharged to a movable paper discharge tray 51 in a middle stage.

The saddle folding unit 30 includes a conveying mechanism 31 configured to convey recording media, a longitudinal alignment device 32 configured to temporarily stack the conveyed recording media and align the recording media in the longitudinal direction and a moving device 33 configured to convey the aligned recording media to a stapling position or a saddle folding position.

The saddle folding unit 30 further includes a stapler 34 and a saddle folding mechanism. The saddle folding mechanism includes a saddle-folding driving roller 35A and a saddle-folding driven roller 35B as a pair of saddle folding rollers configured to saddle-fold recording media, a saddle folding blade 37 configured to push the recording media in a nip section of the saddle-folding driving roller 35A and the saddle-folding driven roller 35B, and an additional folding unit 36 configured to additionally fold the saddle-folded recording media.

The additional folding unit 36 includes a lower additional folding roller 36A and an upper additional folding roller 36B as a pair of additional folding rollers.

The saddle folding rollers have rotation axes in a vertical direction with respect to a sheet conveying direction. The additional folding rollers have rotation axes in parallel to the sheet conveying direction.

The additional folding unit 36 nips a fold of the recording media saddle-folded by the lower additional folding roller 36A and the upper additional folding roller 36B and moves along the rotation axes of the saddle folding rollers to additionally fold the fold.

When stapling is performed, first, recording media are conveyed to the stapling position and stapled by the stapling mechanism 21. Subsequently, the stapled recording media are saddle-folded by the saddle folding unit 30.

The saddle-folded recording media are discharged to a stacking tray 53.

Figure 2:
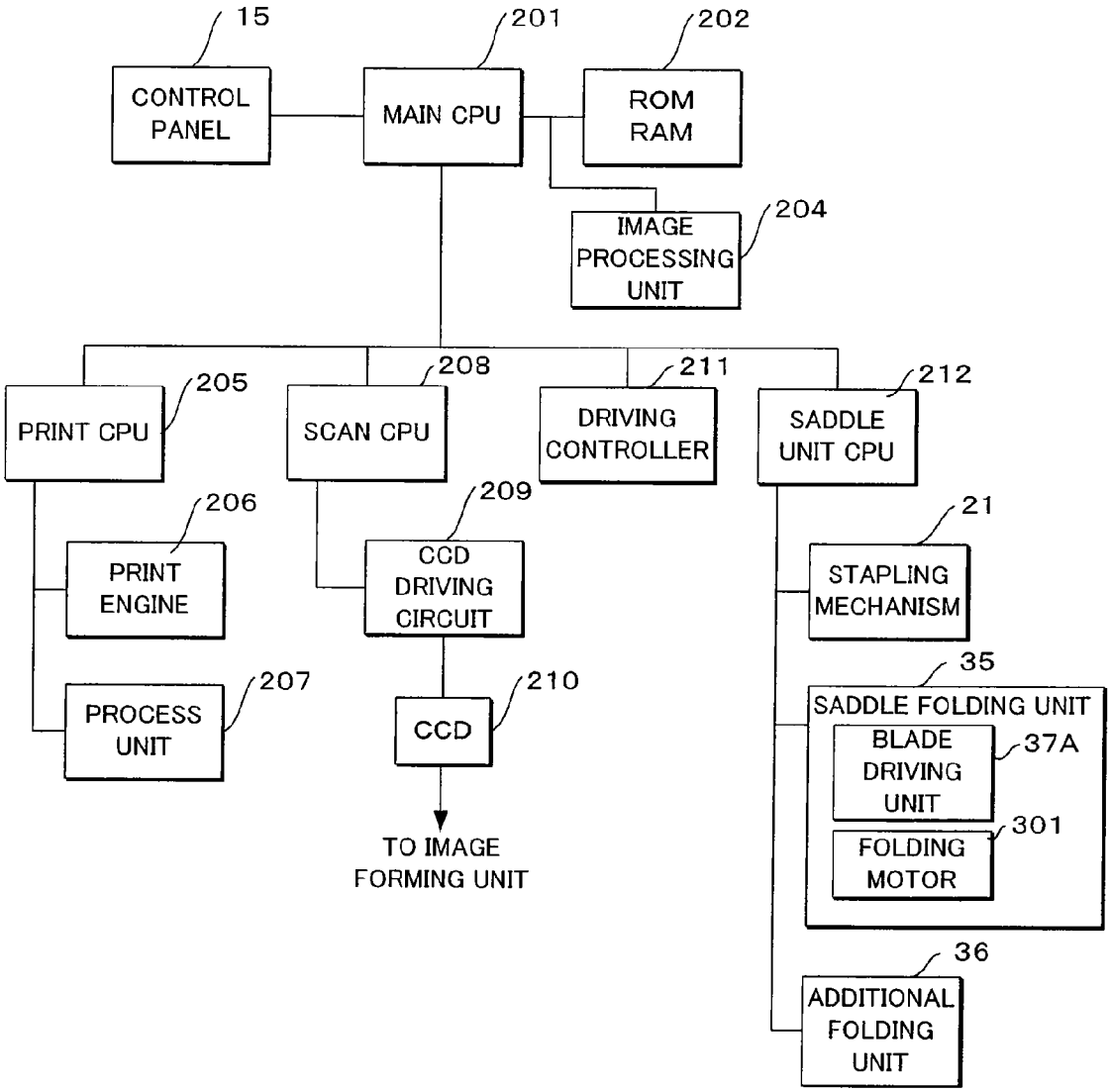
FIG. 2 is a block diagram of a control system for an image forming apparatus and the sheet processing apparatus.

FIG. 2 is a block diagram of a control system for the image forming apparatus 10 and the sheet processing apparatus 20. As shown in FIG. 2, the image forming apparatus 10 includes a main CPU 201 configured to control the entire image forming apparatus 10, a control panel 15 connected to the main CPU 201, memories 202 such as a ROM and a RAM as storage devices, an image processing unit 204 configured to perform image processing, a print CPU 205 configured to perform control of printing, a scan CPU 208 configured to perform control of the scan unit 16, a driving controller 211 configured to control conveying rollers for recording media, and a saddle unit CPU 212 as a control unit configured to control the sheet processing apparatus 20.

The print CPU 205 controls a print engine 206 configured to perform image formation and a process unit 207 configured to fix images formed on recording media.

The scan CPU 208 controls a CCD driving circuit 209 configured to drive a CCD (Charge Coupled Device) 210.

The saddle unit CPU 212 controls the stapling mechanism 21, the saddle folding unit 30, and the additional folding unit 36. The saddle folding unit 30 includes a blade driving unit 37A configured to drive the saddle folding blade and a folding motor 301 configured to drive the saddle-folding driving roller 35A.

Figure 3:
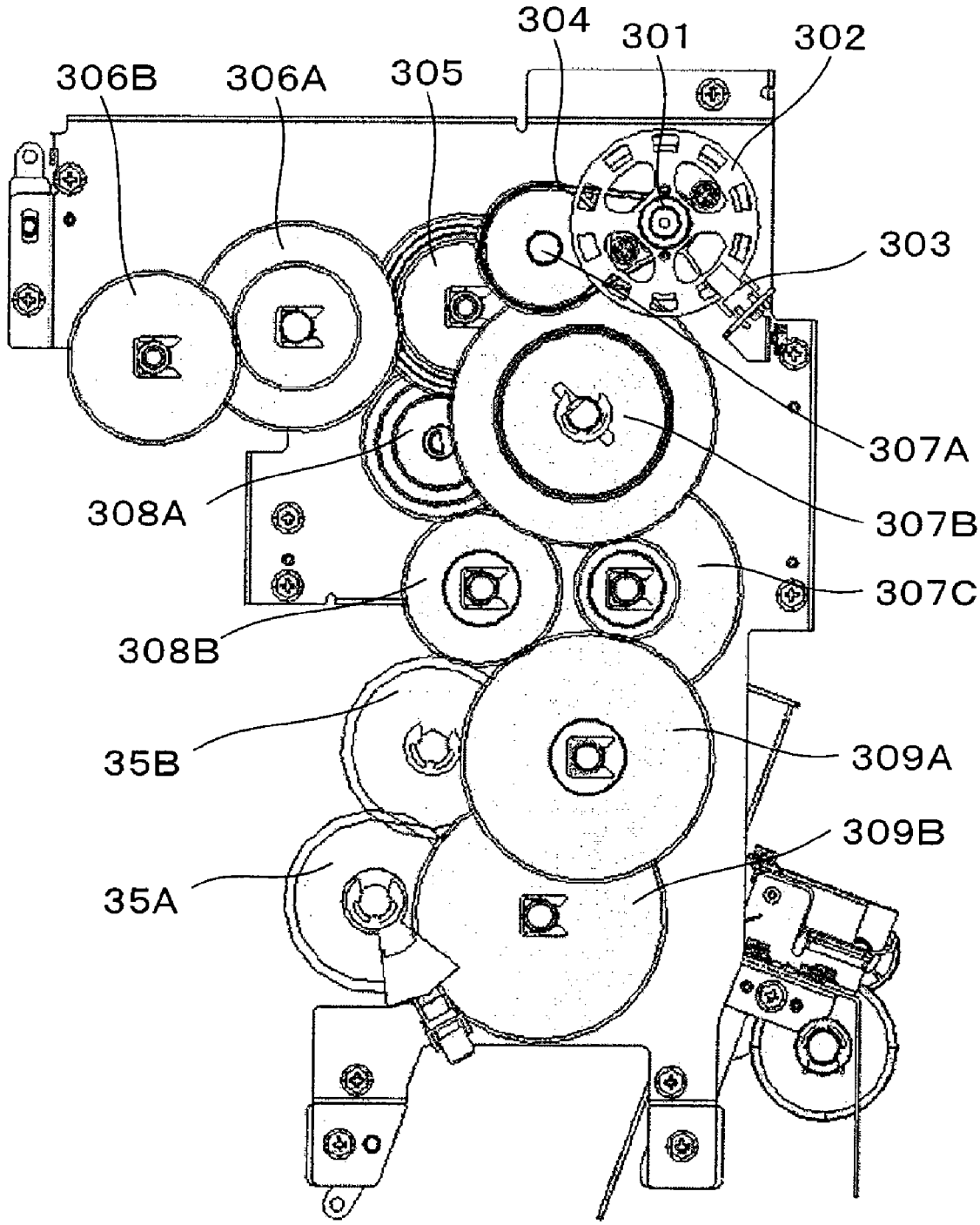
FIG. 3 is a diagram of a driving mechanism for a saddle-folding driving roller and a saddle folding blade.

FIG. 3 is a diagram of a driving mechanism for the saddle-folding driving roller 35 and the saddle folding blade 37. As shown in FIG. 3, the driving mechanism includes the folding motor 301 configured to generate power, an encoder 302 and an encoder sensor 303 configured to detect the rotation of the folding motor 301, a low-speed gear train, and a high-speed gear train.

The sheet processing apparatus 20 selects normal rotation and reverse rotation of the folding motor 301 to thereby selectively drive the low-speed gear train and the high-speed gear train and control the rotating speed and the torque of the saddle-folding driving roller 35A.

The rotation of the folding motor 301 is transmitted to a gear 307A and an electromagnetic clutch 305 by a timing belt 304. The electromagnetic clutch 305 connects a clutch to drive the saddle folding blade 37. The gear 307A drives a selection gear 307B including a one-way clutch.

The one-way clutch drives the low-speed gear train when the folding motor 301 normally rotates. The one-way clutch drives the high-speed gear train when the folding motor 301 reversely rotates.

The low-speed gear train includes a gear 3070, a gear 309A, and a gear 309B. The high-speed gear train includes a gear 308A, a gear 308B, the gear 309A, and the gear 309B.

Figure 4:
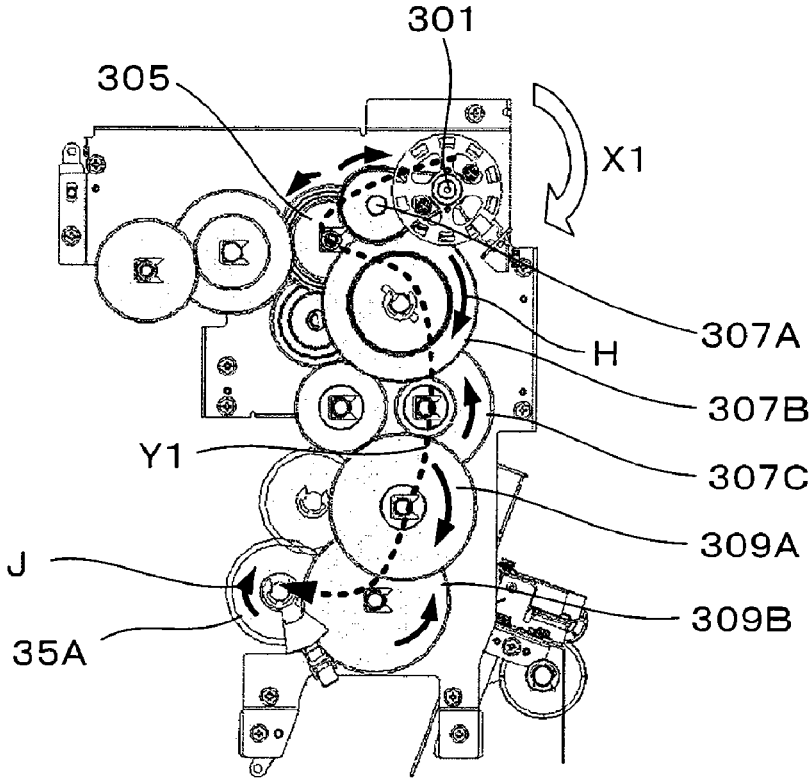
FIG. 4 is a diagram of the operation performed by the driving mechanism when a folding motor normally rotates.

FIG. 4 is a diagram of the operation performed by the driving mechanism when the folding motor 301 normally rotates. As shown in FIG. 4, when the folding motor 301 normally rotates as indicated by an arrow X1, the gear 307A normally rotates, the electromagnetic clutch 305 reversely rotates, and the selection gear 307B is normally rotated by the one-way clutch as indicated by an arrow H. The selection gear 307B reversely rotates the gear 307C, the gear 309A normally rotates, and the gear 309B reversely rotates. The gear 309B normally rotates the saddle-folding driving roller 35A at high torque and low speed as indicated by an arrow J. The rotation of the folding motor 301 is transmitted as indicated by a dotted line arrow Y1.

Figure 5:
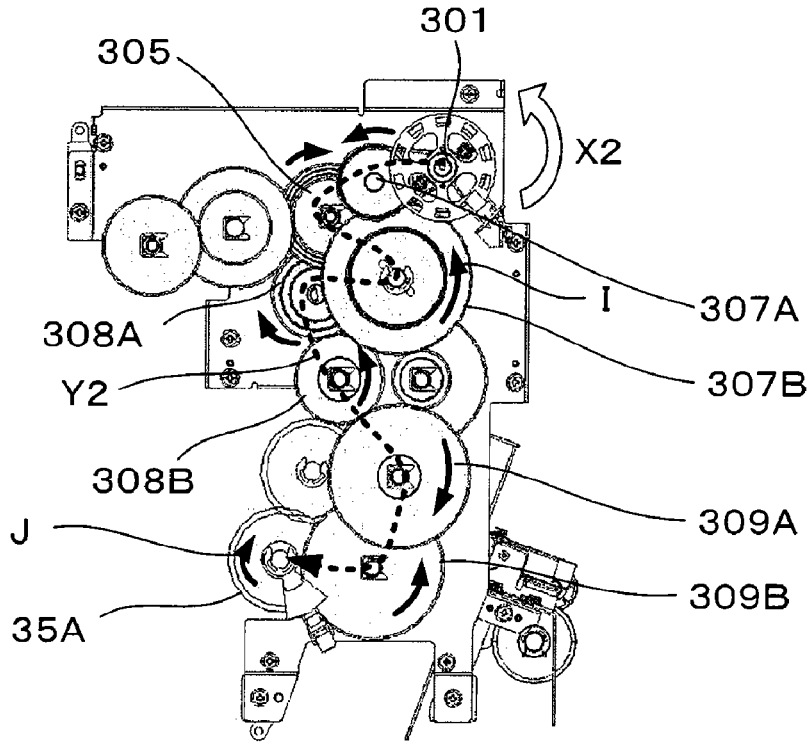
FIG. 5 is a diagram of the operation performed by the driving mechanism when the folding motor reversely rotates.

FIG. 5 is a diagram of the operation performed by the driving mechanism when the folding motor 301 reversely rotates. As shown in FIG. 5, when the folding motor 301 reversely rotates as indicated by an arrow X2, the gear 307A reversely rotates, the electromagnetic clutch 305 normally rotates, and the selection gear 307B is reversely rotated by the one-way clutch as indicated by an arrow I. The selection gear 307B normally rotates the gear 308A, the gear 308B reversely rotates, the gear 309A normally rotates, and the gear 309B reversely rotates. The gear 309B normally rotates the saddle-folding driving roller 35A at low torque and high speed as indicated by an arrow J. The rotation of the folding motor 301 is transmitted as indicated by a dotted line arrow Y2.

Figure 6:
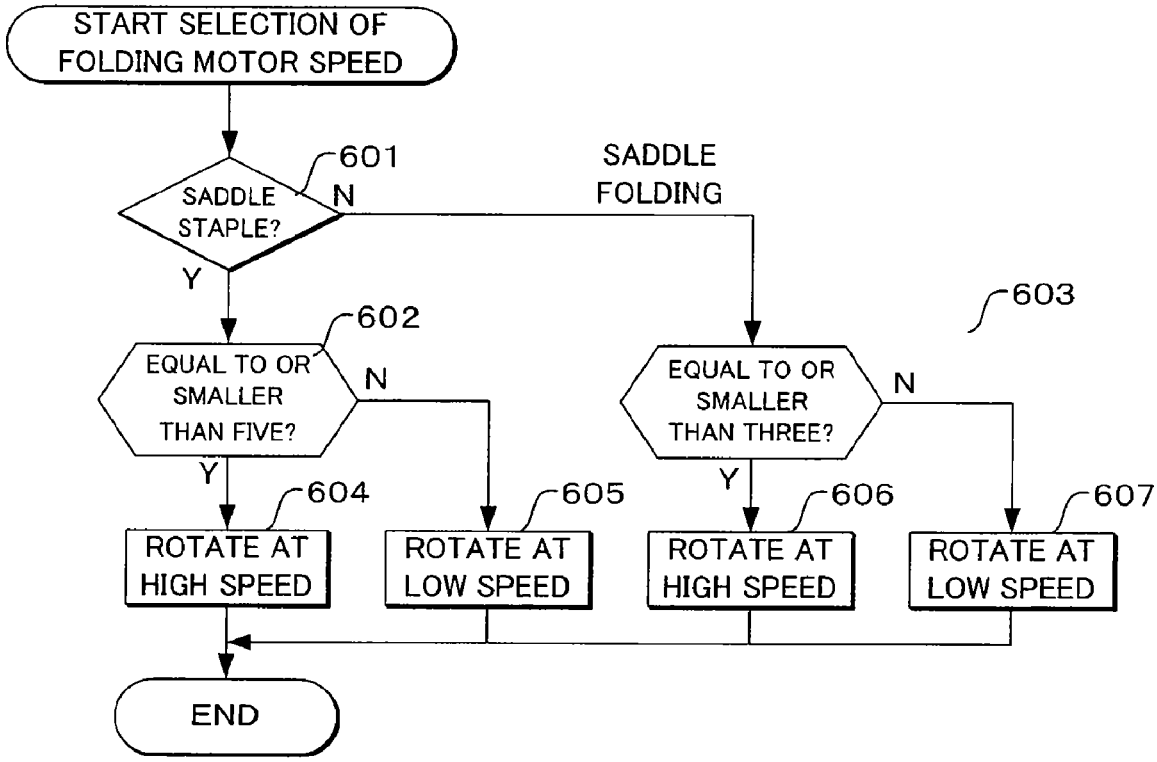
FIG. 6 is a flowchart for explaining a first example of the operation for selecting folding motor speed of the sheet processing apparatus.

FIG. 6 is a diagram of a first example of the operation for selecting folding motor speed of the sheet processing apparatus 20. As shown in FIG. 6, in Act 601, the sheet processing apparatus 20 determines whether saddle stapling is designated. When the saddle stapling is designated, recording media are stapled before being saddle-folded.

When the sheet processing apparatus 20 determines that saddle stapling is designated, the sheet processing apparatus 20 proceeds to Act 602. When the sheet processing apparatus 20 determines that the saddle stapling is not designated, the sheet processing apparatus 20 proceeds to Act 603 in order to perform saddle folding.

In Act 602, the sheet processing apparatus 20 determines whether the number of processed recording media counted by number-of-sheets counting processing performed before the operation for selecting folding motor speed is performed is equal to or smaller than a first predetermined number, for example, five.

When the number of processed recording media is equal to or smaller than five, in Act 604, the sheet processing apparatus 20 rotates the saddle-folding driving roller 35A at high speed. When the number of processed recording media is not equal to or smaller than five, in Act 605, the sheet processing apparatus 20 rotates the saddle-folding driving roller 35A at low speed.

In Act 603, the sheet processing apparatus 20 determines whether the number of processed recording media is equal to or smaller than a second predetermined number smaller than the first predetermined number, for example, three. When the number of processed recording media is equal to or smaller than three, in Act 606, the sheet processing apparatus 20 rotates the saddle-folding driving roller 35A at high speed. When the number of processed recording media is not equal to or smaller than three, in Act 607, the sheet processing apparatus 20 rotates the saddle-folding driving roller 35A at low speed.

The second predetermined number is smaller than the first predetermined number because, when recording media are saddle-folded without being stapled, the recording media tend to shift if the saddle folding is performed at high speed.

Figure 7:
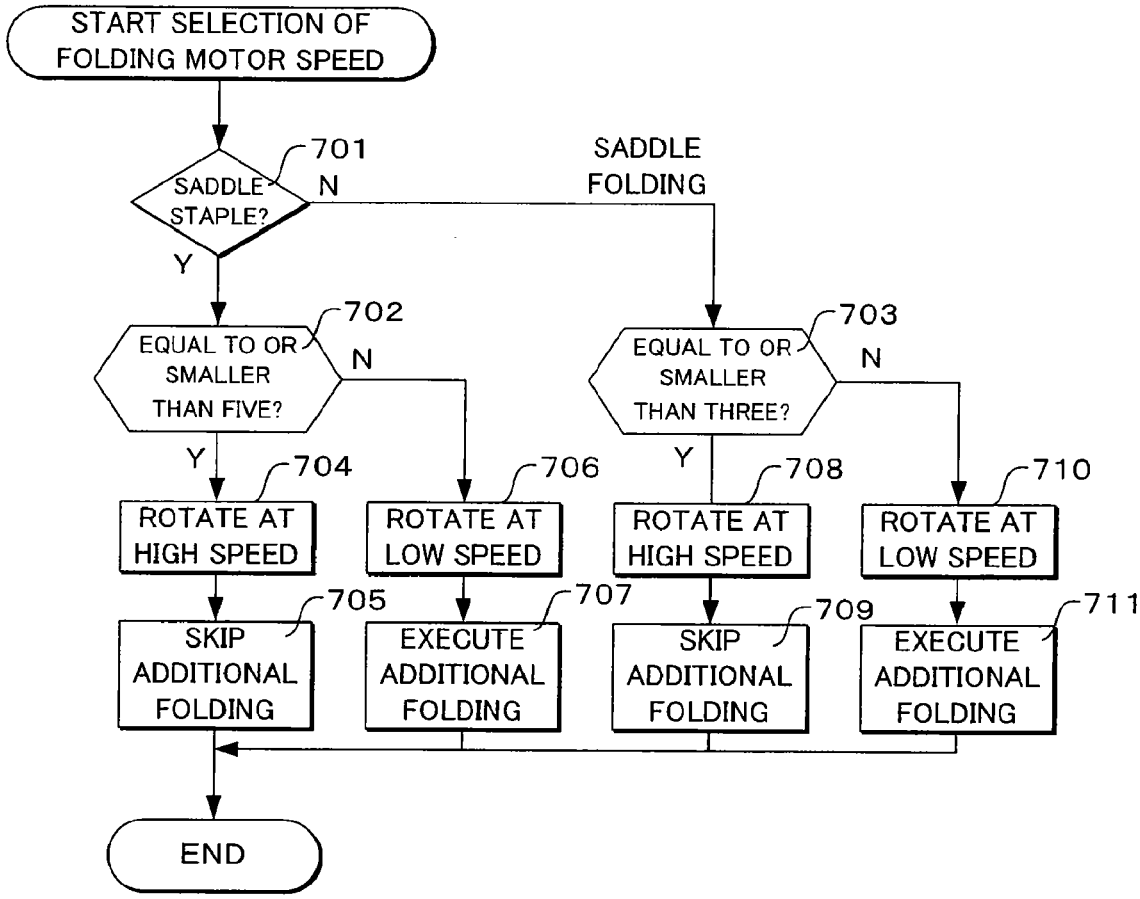
FIG. 7 is a flowchart for explaining a second example of the operation for selecting folding motor speed of the sheet processing apparatus.

FIG. 7 is a diagram of a second example of the operation for selecting folding motor speed of the sheet processing apparatus 20. As shown in FIG. 7, in Act 701, the sheet processing apparatus 20 determines whether saddle stapling is designated. When the saddle stapling is designated, recording media are stapled before being saddle-folded.

When the sheet processing apparatus 20 determines that the saddle stapling is designated, the sheet processing apparatus 20 proceeds to Act 702. When the sheet processing apparatus 20 determines that the saddle stapling is not designated, the sheet processing apparatus 20 proceeds to Act 703 in order to perform saddle folding.

In Act 702, the sheet processing apparatus 20 determines whether the number of processed recording media counted by number-of-sheets counting processing performed before the operation for selecting folding motor speed is performed is equal to or smaller than a first predetermined number, for example, five.

When the number of processed recording media is equal to or smaller than five, in Act 704, the sheet processing apparatus 20 rotates the saddle-folding driving roller 35A at high speed and, in Act 705, skips additional folding operation to omit the additional folding operation.

When the number of processed recording media is not equal to or smaller than five, in Act 706, the sheet processing apparatus 20 rotates the saddle-folding driving roller 35A at low speed and, in Act 707, executes the additional folding operation.

In Act 703, the sheet processing apparatus 20 determines whether the number of processed recording media is equal to or smaller than a second predetermined number smaller than the first predetermined number, for example, three.

When the number of processed recording media is equal to or smaller than three, in Act 708, the sheet processing apparatus 20 rotates the saddle-folding driving roller 35A at high speed and, in Act 709, skips the additional folding operation to omit the additional folding operation.

When the number of processed recording media is not equal to or smaller than three, in Act 710, the sheet processing apparatus 20 rotates the saddle-folding driving roller 35A at low speed and, in Act 711, executes the additional folding operation.

As explained above, the sheet processing apparatus 20 according to this embodiment includes the control unit, the folding motor 301, a rotating direction of which is controlled by the control unit, the low-speed gear train driven when the folding motor 301 normally rotates, the high-speed gear train driven when the folding motor 301 reversely rotates, and the saddle-folding driving roller driven by a gear train selected from the low-speed gear train and the high-speed gear train. When the number of recording media to be saddle-stapled or saddle-folded exceeds predetermined numbers respectively set for the saddle stapling and the saddle folding, the saddle-folding driving roller 35A is driven at low speed. When the number of recording media to be saddle-stapled or saddle-folded does not exceed the predetermined numbers, the saddle-folding driving roller 35A is driven at high speed.

Therefore, there is an effect that it is possible to reduce, according to the number of recording media to be saddle-stapled and saddle-folded, time required for the saddle stapling and the saddle folding.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A sheet processing apparatus comprising:

a moving unit configured to move a plurality of stacked sheets to a saddle folding position;

a saddle folding blade configured to push in the sheets moved to the saddle folding position;

a pair of saddle-folding rollers configured to hold and fold the pushed-in sheets; and a control unit configured, when saddle stapling is performed, to cause the saddle-folding rollers to be driven at low speed when a number of sheets to be saddle-stapled exceeds a first predetermined number and at high speed when the number of sheets to be saddle-stapled does not exceed the first predetermined number, and when the saddle stapling is not performed, to cause the saddle-folding rollers to be driven at low speed when a number of sheets to be saddle-folded exceeds a second predetermined number and at high speed when the number of sheets to be saddle-folded does not exceed the second predetermined number.

2. A sheet processing apparatus comprising:

a moving unit configured to move a plurality of stacked sheets to a saddle folding position;

a saddle folding blade configured to push in the sheets moved to the saddle folding position;

a pair of saddle-folding rollers configured to hold and fold the pushed-in sheets; and an additional folding unit configured to hold a fold of the sheets saddle-folded by the saddle-folding rollers and move along the fold to strengthen the fold, and a control unit configured, when the control unit causes the saddle-folding rollers to be driven at low speed, to control the additional folding unit to strengthen the fold, and when the control unit causes the saddle-folding rollers to be driven at high speed, to not control the additional folding unit strengthen the fold.

3. The apparatus according to claim 2, wherein when saddle stapling is performed, the control unit causes the saddle-folding rollers to be driven at low speed when a number of sheets to be saddle-stapled exceeds a first predetermined number and at high speed when the number of recording media to be saddle-stapled does not exceed the first predetermined number, and when the saddle stapling is not performed, the control unit causes the saddle-folding rollers to be driven at low speed when a number of sheets to be saddle-folded exceeds a second predetermined number and at high speed when the number of sheets to be saddle-folded does not exceed the second predetermined number.

4. The apparatus according to claim 3, further comprising:

a folding motor configured to drive the saddle-folding rollers;

a low-speed gear train configured to be driven when the folding motor rotates in a first direction and configured to drive the saddle-folding rollers at low speed; and a high-speed gear train configured to be driven when the folding motor rotates in a second direction that is opposite the first direction and configured to drive the saddle-folding rollers at high speed, wherein when saddle stapling is performed, the control unit rotates the folding motor in the first direction when a number of sheets to be saddle-stapled exceeds a first predetermined number and in the second direction when the number of sheets to be saddle-stapled does not exceed the first predetermined number, and when the saddle stapling is not performed, the control unit rotates the folding motor in the first direction when a number of sheets to be saddle-folded exceeds a second predetermined number and in the second direction when the number of sheets to be saddle-folded does not exceed the second predetermined number.

5. The apparatus according to claim 2, further comprising:

a folding motor configured to drive the saddle-folding rollers;

a low-speed gear train configured to be driven when the folding motor rotates in a first direction, and configured to drive the saddle-folding rollers at low speed; and a high-speed gear train configured to be driven when the folding motor rotates in a second direction that is opposite the first direction, and configured to drive the saddle-folding rollers at high speed, wherein when the control unit causes the folding motor to rotate in the first direction, the control unit controls the additional folding unit to strengthen the fold, and when the control unit causes the folding motor to rotate in the second direction, the control unit does not control the additional folding to strengthen the fold.

6. The apparatus according to claim 5, further comprising:

a selection gear including a one-way clutch configured to drive the low-speed gear train when the folding motor rotates in the first direction and drive the high-speed gear train when the folding motor rotates in the second direction, wherein when the control unit rotates the folding motor in the first direction, the control unit causes the additional folding unit to strengthen the fold, and when the control unit reversely rotates the folding motor in the second direction, the control unit omits the additional folding.

7. A sheet processing apparatus comprising:

a moving unit configured to move a plurality of stacked sheets to a saddle folding position;

a saddle folding blade configured to push in the sheets moved to the saddle folding position;

a pair of saddle-folding rollers configured to hold and fold the pushed-in sheets;

a folding motor configured to drive the saddle-folding rollers;

a low-speed gear train configured to be driven when the folding motor rotates in a first direction, and configured to drive the saddle-folding rollers at low speed; and a high-speed gear train configured to be driven when the folding motor rotates in a second direction that is opposite the first direction, and configured to drive the saddle-folding rollers at high speed, and a control unit configured to rotate the folding motor in the first direction when the number of sheets to be saddle-folded exceeds the predetermined number and in the second direction when the number of sheets to be saddle-folded does not exceed the predetermined number.

8. The apparatus according to claim 7, wherein when saddle stapling is performed, the control unit rotates the folding motor in the first direction when a number of sheets to be saddle-stapled exceeds a first predetermined number and in the second direction when the number of sheets to be saddle-stapled does not exceed the first predetermined number, and when the saddle stapling is not performed, the control unit rotates the folding motor in the first direction when a number of sheets to be saddle-folded exceeds a second predetermined number and in the second direction when the number of sheets to be saddle-folded does not exceed the second predetermined number.

9. The apparatus according to claim 8, further comprising:

a selection gear including a one-way clutch configured to drive the low-speed gear train when the folding motor rotates in the first direction and drive the high-speed gear train when the folding motor rotates in the second direction, wherein when saddle stapling is performed, the control unit rotates the folding motor in the first direction when a number of sheets to be saddle-stapled exceeds a first predetermined number and in the second direction when the number of sheets to be saddle-stapled does not exceed the first predetermined number, and when the saddle stapling is not performed, the control unit rotates the folding motor in the first direction when a number of sheets to be saddle-folded exceeds a second predetermined number and in the second direction when the number of sheets to be saddle-folded does not exceed the second predetermined number.

10. The apparatus according to claim 7, wherein the control unit rotates the folding motor in the first direction when the number of sheets to be saddle-folded exceeds the predetermined number and in the second direction when the number of sheets to be saddle-folded does not exceed the predetermined number.

11. The apparatus according to claim 7, further comprising:

a selection gear including a one-way clutch configured to drive the low-speed gear train when the folding motor rotates in the first direction and drive the high-speed gear train when the folding motor rotates in the second direction, wherein when saddle stapling is performed, the control unit rotates the folding motor in the first direction when a number of sheets to be saddle-stapled exceeds a first predetermined number and in the second direction when the number of sheets to be saddle-stapled does not exceed the first predetermined number, and when the saddle stapling is not performed, the control unit rotates the folding motor in the first direction when a number of sheets to be saddle-folded exceeds a second predetermined number and in the second direction when the number of sheets to be saddle-folded does not exceed the second predetermined number.

12. A saddle folding speed control method for a plurality of stacked sheet processing apparatus, comprising:

moving the aligned sheets to a saddle folding position;

folding the sheets moved to the saddle folding position with a saddle folding blade and a pair of saddle-folding rollers; and when saddle stapling is performed, driving the saddle-folding rollers at low speed when a number of sheets to be saddle-stapled exceeds a first predetermined number and driving the saddle-folding rollers at high speed when the number of sheets to be saddle-stapled does not exceed the first predetermined number, and when the saddle stapling is not performed, driving the saddle-folding rollers at low speed when a number of sheets to be saddle-folded exceeds a second predetermined number and driving the saddle-folding rollers at high speed when the number of sheets to be saddle-folded does not exceed the second predetermined number.

13. The method according to claim 12, wherein when saddle stapling is performed, normally rotating a folding motor in a first direction to thereby drive the saddle-folding rollers at low speed when a number of sheets to be saddle-stapled exceeds a first predetermined number and reversely rotating the folding motor in a second direction opposite the first direction to thereby drive the saddle-folding rollers at high speed when the number of sheets to be saddle-stapled does not exceed the first predetermined number, and when the saddle stapling is not performed, normally rotating the folding motor in the first direction to thereby drive the saddle-folding rollers at low speed when a number of sheets to be saddle-folded exceeds a second predetermined number and reversely rotating the folding motor in the second direction to thereby drive the saddle-folding rollers at high speed when the number of sheets to be saddle-folded does not exceed the second predetermined number.

14. A saddle folding speed control method for a plurality of stacked sheet processing apparatus, comprising:

moving the aligned sheets to a saddle folding position;

folding the sheets moved to the saddle folding position with a saddle folding blade and a pair of saddle-folding rollers; and when saddle stapling is performed, driving the saddle-folding rollers at low speed when a number of sheets to be saddle-stapled exceeds a first predetermined number and driving the saddle-folding rollers at high speed when the number of sheets to be saddle-stapled does not exceed the first predetermined number, and controlling an additional folding unit to strengthen the fold, and when the saddle stapling is not performed, driving the saddle-folding rollers at low speed when a number of sheets to be saddle-folded exceeds a second predetermined number and driving the saddle-folding rollers at high speed when the number of sheets to be saddle-folded does not exceed the second predetermined number, and not controlling the additional folding unit to strength the fold.

15. The method according to claim 14, wherein when saddle stapling is performed, driving the saddle-folding rollers at low speed and controlling an additional folding unit to strengthen the fold when a number of sheets to be saddle-stapled exceeds a first predetermined number and driving the saddle-folding rollers at high speed and not controlling the additional folding unit to strengthen the fold when the number of sheets to be saddle-stapled does not exceed the first predetermined number, and when the saddle stapling is not performed, driving the saddle-folding rollers at low speed and controlling the additional folding unit to strengthen the fold when a number of sheets to be saddle-folded exceeds a second predetermined number and driving the saddle-folding rollers at high speed and not controlling the additional folding unit to strengthen the fold when the number of sheets to be saddle-folded does not exceed the second predetermined number.

16. The method according to claim 15, wherein when saddle stapling is performed, normally rotating a folding motor in a first direction to thereby drive the saddle-folding rollers at low speed when a number of sheets to be saddle-stapled exceeds a first predetermined number and reversely rotating the folding motor in a second direction opposite the first direction to thereby drive the saddle-folding rollers at high speed when the number of sheets to be saddle-stapled does not exceed the first predetermined number, and when the saddle stapling is not performed, normally rotating the folding motor in the first direction to thereby drive the saddle-folding rollers at low speed the fold when a number of sheets to be saddle-folded exceeds a second predetermined number and reversely rotating the folding motor in the second direction to thereby drive the saddle-folding rollers at high speed when the number of sheets to be saddle-folded does not exceed the second predetermined number.

17. The method according to claim 14, wherein in case of normally rotating a folding motor to thereby drive the saddle-folding driving motor at low speed, controlling an additional folding unit to strengthen the fold, and in case of reversely rotating the folding motor to thereby drive the saddle-folding driving motor at high speed, not controlling the additional folding unit to strengthen the fold.

* * * * *